US005325024A

United States Patent [19]

Piejak et al.

[11] Patent Number: 5,325,024

[45] Date of Patent: Jun. 28, 1994

[54] LIGHT SOURCE INCLUDING PARALLEL DRIVEN LOW PRESSURE RF FLUORESCENT LAMPS

[75] Inventors: Robert B. Piejak, Wayland; Valery Godyak; Benjamin A. Alexsandrovich, both of Brookline, all of Mass.

[73] Assignee: GTE Products Corporation, Danvers, Mass.

[21] Appl. No.: 962,378

[22] Filed: Oct. 16, 1992

[51] Int. Cl.[5] ..... H05B 41/16

[52] U.S. Cl. ..... 315/248; 315/246; 315/254; 315/324; 315/344; 315/205; 315/35

[58] Field of Search ..... 315/246, 248, 254, 324, 315/344, 35, 205

[56] References Cited

U.S. PATENT DOCUMENTS

| | | | |
|---|---|---|---|
| 2,139,815 | 12/1938 | Fodor | 315/246 |
| 4,005,330 | 1/1977 | Glascock et al. | 315/57 |
| 4,010,400 | 3/1977 | Hollister | 315/248 |
| 4,017,764 | 4/1977 | Anderson | 315/248 |
| 4,189,661 | 2/1980 | Haugsjaa et al. | 315/39 |
| 4,266,167 | 5/1981 | Proud et al. | 315/248 |
| 4,427,923 | 1/1984 | Proud et al. | 315/248 |
| 4,631,449 | 12/1986 | Peters, Jr. | 315/205 |
| 4,798,997 | 1/1989 | Egami et al. | 315/115 |

*Primary Examiner*—Robert J. Pascal
*Assistant Examiner*—Haissa Philogene
*Attorney, Agent, or Firm*—Carlo S. Bessone

[57] ABSTRACT

A fluorescent light source includes multiple fluorescent lamp tubes driven in parallel by a single RF source. The fluorescent lamp tubes can be twin tube fluorescent lamps or straight fluorescent lamps. RF electrical energy is capacitively coupled to low pressure discharges within each fluorescent lamp tube. External capacitive coupling electrodes can be formed at or near the ends of each fluorescent lamp tube. Alternatively, cold cathode electrodes can be located within the fluorescent lamp tubes. Ballasting of the fluorescent lamp tubes is provided by capacitive coupling between the plasma of the low pressure discharge and the electrodes, thus eliminating the need for external ballasting components.

28 Claims, 6 Drawing Sheets

LIGHT SOURCE INCLUDING PARALLEL DRIVEN LOW PRESSURE RF FLUORESCENT LAMPS

FIELD OF THE INVENTION

This invention relates to fluorescent light sources and, more particularly, to fluorescent light sources wherein fluorescent lamps are driven by an RF source without ballasting, thus permitting the fluorescent lamps to be operated in parallel.

BACKGROUND OF THE INVENTION

Low pressure fluorescent lamps cannot normally be operated in parallel electrical paths because the breakdown/starting voltage is larger than the operating voltage, and the lamps cannot be made such that a discharge is initiated in all lamps simultaneously. After one lamp breaks down, the voltage applied to all lamps drops significantly and is not large enough to break down the other lamps. Even if a discharge could be initiated in all lamps, discharge lamps driven at low frequencies or with DC cannot be operated in parallel without ballasting because low pressure discharges have a negative voltage/current (V/I) characteristic. The negative V/I characteristic means that as the lamp current increases, the lamp voltage decreases. Thus, when several lamps are connected in parallel and all are ignited, one lamp normally operates at a higher current and lower discharge voltage than the others. This lamp will cause all the other lamps to be extinguished.

Compact fluorescent lamps are considerably more efficient than incandescent lamps, but they are limited in total lumen output. For example, a compact fluorescent lamp about the same size as a 100 watt incandescent lamp provides about 900 lumens, which is sufficient to replace only a 60 watt incandescent lamp. The total amount of light emitted per unit volume can be increased considerably by reducing the diameter of the discharge. With a reduced diameter, the electron temperature increases and the maximum light emitted per unit volume increases. To achieve a higher lumen output from a smaller diameter fluorescent lamp, however, the discharge length must be increased to keep the discharge volume constant. The result is a long, small diameter discharge which requires an intricate pattern of multiple bends to provide a compact lamp. Although technically feasible, this lamp is impractical and expensive because it is fragile and is virtually impossible to mass produce.

Current compact fluorescent lamps use a twin tube or double twin tube architecture. Twin tube fluorescent lamps typically include a pair of straight tubes that are interconnected at or near one end to form a generally U-shaped tube. These lamps are an improvement over a single large diameter tube, but even the double twin tube lamp is limited to four tubes driven in series. If eight tubes are needed, two double twin tubes may employed, but this requires two ballasts and is expensive as well as bulky and impractical.

Electrodeless fluorescent light sources utilizing inductive coupling have been disclosed in various U.S. patents. A closed loop magnetic core transformer, contained within a reentrant cavity in the lamp envelope, induces a discharge in an electrodeless fluorescent lamp in U.S. Pat. No. 4,005,330 issued Jan. 25, 1977 to Glascock et al. The discharge is induced by a magnetic core coil within the envelope of an electrodeless fluorescent lamp in the light source disclosed in U.S. Pat. No. 4,017,764 issued Apr. 12, 1977 to Anderson. In both of the above mentioned patents, the operating frequency is limited to about 50 kHz because of the lossy nature of magnetic materials at high frequency. An electrodeless fluorescent light source utilizing an air core coil for inductive coupling at a frequency of about 4 MHz is disclosed in U.S. Pat. No. 4,010,400 issued Mar. 1, 1977 to Hollister. However, such a light source has a tendency to radiate power at the frequency of operation and exhibits nonuniform plasma excitation.

An electrodeless fluorescent light source, utilizing frequencies in the 100 MHz to 300 GHz range, is disclosed by Haugsjaa et al in U.S. Pat. No. 4,189,661 issued Feb. 19, 1980. High frequency power, typically at 915 MHz, is coupled to an ultraviolet-producing low pressure discharge in a phosphor-coated electrodeless lamp which acts as a termination within a termination fixture.

A compact fluorescent light source wherein high frequency power is capacitively coupled to a low pressure discharge is disclosed in U.S. Pat. No. 4,266,167 issued May 5, 1981 to Proud et al. The lamp envelope has an outer shape similar to that of an incandescent lamp. An outer conductor, typically a conductive mesh, is disposed on the outer surface of the lamp envelope, and an inner conductor is disposed in a reentrant cavity in the lamp envelope. Frequencies in the range of 10 MHz to 10 GHz are suggested. An electrodeless discharge tube wherein high frequency energy is coupled to a discharge through external electrodes is disclosed in U.S. Pat. No. 4,798,997 issued Jan. 17, 1989 to Egami et al. Another electrodeless fluorescent light source which is energized by a high frequency power source is disclosed in U.S. Pat. No. 4,427,923 issued Jan. 24, 1984 to Proud et al.

It is a general object of the present invention to provide improved fluorescent light sources.

It is another object of the present invention to provide a fluorescent light source wherein multiple fluorescent lamp tubes are electrically connected in parallel to a single RF source.

It is a further object of the present invention to provide a compact fluorescent lamp having high lumen output.

It is yet another object of the present invention to provide fluorescent light sources which are low in cost and which are easy to manufacture.

SUMMARY OF THE INVENTION

These and other objects and advantages are achieved in accordance with a first aspect of the invention in a fluorescent light source comprising a plurality of fluorescent lamp assemblies, each including first and second fluorescent lamp tubes having capacitive coupling electrodes at or near the ends thereof for capacitive coupling of RF electrical energy to a low pressure discharge therein, each fluorescent lamp tube having a driven end and an opposite end, and means for electrically coupling the electrodes at the opposite ends of the first and second fluorescent lamp tubes together. The light source further comprises a single RF source having a first output terminal electrically connected to the electrodes at the driven ends of each of the first fluorescent lamp tubes and having a second output terminal electrically connected to the electrodes at the driven ends of each of the second fluorescent lamp tubes such that the fluorescent lamp assemblies are driven in parallel by the RF source, and starting means for initiating low pressure discharges within each of the fluorescent lamp tubes.

In the above-described light source, the RF source preferably includes means for applying RF voltages of equal amplitudes and opposite polarities to the electrodes at the driven ends of the first and second fluorescent lamp tubes. This can be achieved by providing the RF source with an output transformer having a grounded center tap. In this case, the electrodes opposite the driven ends of the fluorescent lamp tubes are at virtual ground.

According to a second aspect of the invention, a fluorescent light source comprises a plurality of fluorescent lamp tubes, each containing a fill material for sustaining a low pressure discharge and having first and second electrodes at or near the ends thereof for capacitive coupling of RF electrical energy to a low pressure discharge within the lamp tube, a single RF source having a first output terminal electrically coupled to the first electrode of each fluorescent lamp tube and a second output terminal electrically coupled to the second electrode of each fluorescent lamp tube so that the fluorescent lamp tubes are electrically connected in parallel, and starting means for initiating a low pressure discharge within each of the fluorescent lamp tubes. Each of the fluorescent lamp tubes can be a twin tube fluorescent lamp having a generally U-shaped configuration such that the first and second electrodes of each fluorescent lamp tube are located adjacent to each other. Alternatively, each of the fluorescent lamp tubes can be substantially straight.

According to a third aspect of the invention, a fluorescent light source comprises first and second fluorescent lamp tubes having capacitive coupling electrodes at or near the ends thereof for capacitive coupling of RF electrical energy to a low pressure discharge in the respective lamp tube, each fluorescent lamp tube having a driven end and an opposite end, means for electrically coupling the electrodes at the opposite ends of the first and second fluorescent lamp tubes together, a RF source having a first output terminal electrically coupled to the electrode at the driven end of the first fluorescent lamp tube and having a second output terminal electrically coupled to the electrode at the driven end of the second fluorescent lamp tube, and starting means for initiating low pressure discharges within the first and second fluorescent lamp tubes.

The fluorescent light sources of the present invention permit multiple fluorescent lamp tubes to be driven in parallel with a single RF source, without requiring external ballasting of each fluorescent lamp tube. The RF source is preferably in a frequency range of about 3 MHz to 300 MHz and is most preferably in a frequency range of about 10 MHz to 100 MHz.

The capacitive coupling electrodes can comprise conductive layers on the outside surface of each fluorescent lamp tube at or near the ends thereof. In this configuration, the fluorescent lamp tubes are electrodeless. In an alternative configuration, the electrodes can comprise cold cathode electrodes located within each fluorescent lamp tube at or near the ends thereof.

The starting means preferably comprises means for applying the voltage of the RF source across a diameter of each of the fluorescent lamp tubes. Starting electrodes can be diametrically positioned with respect to each of the fluorescent lamps and electrically connected to the RF source. Preferably, the starting electrodes have sufficiently small current capacity to avoid interference with operation of the fluorescent lamp tube after starting. The breakdown voltage for initiating discharge within the fluorescent lamp tubes is lower than the operating voltage of the lamps, thus ensuring that a discharge is initiated in all of the fluorescent lamp tubes.

BRIEF DESCRIPTION OF THE DRAWINGS

For a better understanding of the present invention, together with other and further objects, advantages and capabilities thereof, reference is made to the accompanying drawings, which are incorporated herein by reference and in which.

DETAILED DESCRIPTION OF THE INVENTION

Figure 1:
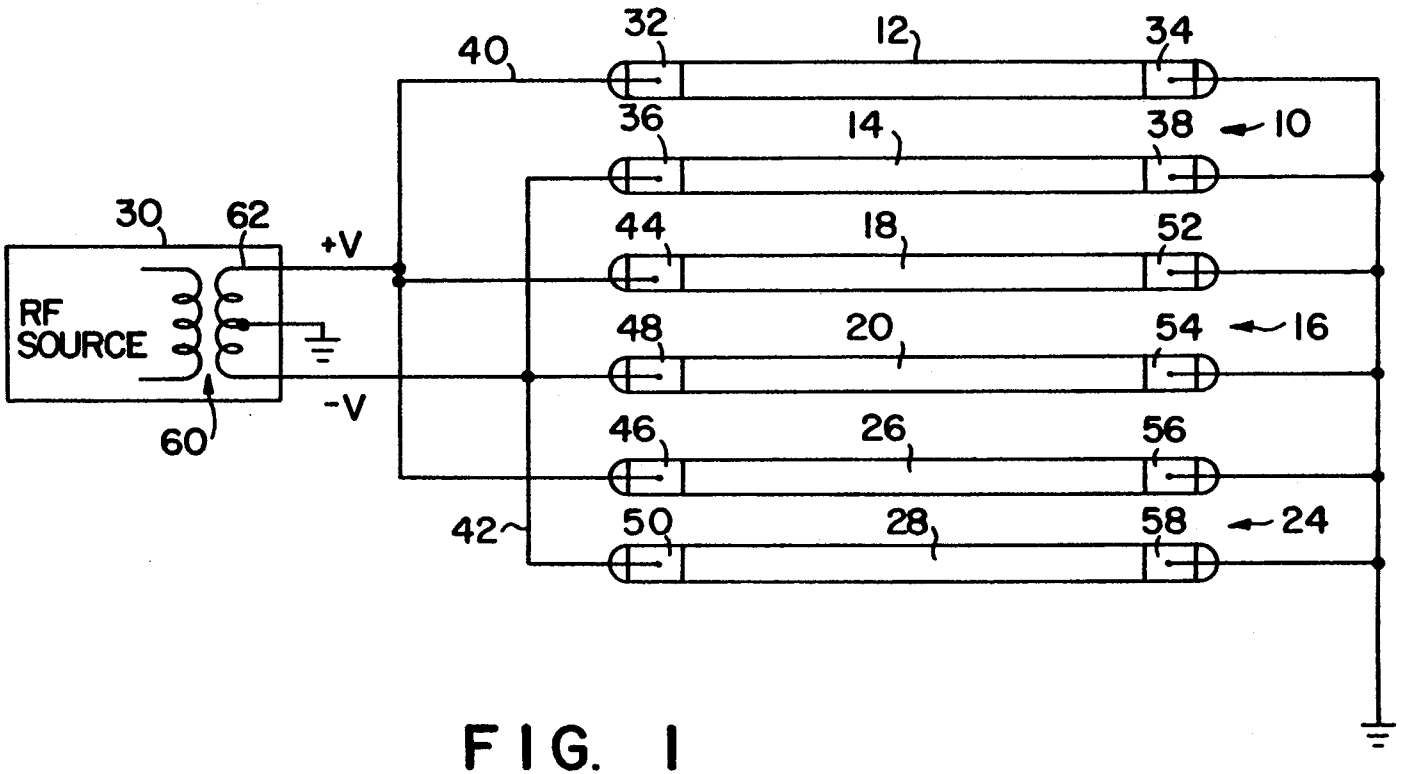
FIG. 1 is a schematic diagram of a fluorescent light source in accordance with the present invention wherein multiple straight fluorescent lamp tubes are driven by a single RF source.

A schematic diagram of a fluorescent light source in accordance with a first aspect of the present invention is shown in FIG. 1. A first fluorescent lamp assembly 10 includes a fluorescent lamp tube 12 and a fluorescent lamp tube 14. A second fluorescent lamp assembly 16 includes fluorescent lamp tubes 18 and 20. A third fluorescent lamp assembly 24 includes fluorescent lamp tubes 26 and 28. The fluorescent lamp assemblies 10, 16 and 24 are electrically connected in parallel to the output terminals of a radio frequency (RF) source 30 as described below.

Fluorescent lamp tubes 12 and 14 each contain a fill material, such as argon and mercury, for sustaining a low pressure discharge and have phosphor coatings on their inside surfaces. Lamp tube 12 has electrodes 32 and 34 at or near the ends thereof for capacitive coupling of RF electrical energy from source 30 to a low pressure discharge within lamp tube 12. Lamp tube 14 has electrodes 36 and 38 at or near the ends thereof for capacitive coupling of RF electrical energy to a low pressure discharge in lamp tube 14. In the embodiment of FIG. 1, electrodes 32, 34, 36 and 38 are external to the respective lamp tubes. The low pressure discharges within lamp tubes 12 and 14 emit radiation, typically in the ultraviolet, which stimulates emission of visible light by the phosphor coatings. In a preferred embodiment, the lamp tubes 12 and 14 are elongated, straight tubes and are mounted parallel to each other. The fluorescent lamp assemblies 16 and 24 typically have the same construction as fluorescent lamp assembly 10.

An output terminal 40 of RF source 30 is connected to electrode 32 at a driven end of lamp tube 12, and an output terminal 42 of RF source 30 is connected to electrode 36 at a driven end of lamp tube 14. Electrode 34 at the opposite end of lamp tube 12 and electrode 38 at the opposite end of lamp tube 14 are electrically connected together, thus completing the electrical path between terminals 40 and 42. The output terminals 40 and 42 carry opposite phases of the RF output of source 30. As described in more detail below, the RF source output is preferably balanced with respect to ground. Output terminal 40 is connected to an electrode 44 at a driven end of lamp tube 18 and an electrode 46 at a driven end of lamp tube 26. Output terminal 42 is connected to an electrode 48 at a driven end of lamp 20 and an electrode 50 at a driven end of lamp tube 28. An electrode 52 at the opposite end of lamp tube 18 is electrically connected to an electrode 54 at the opposite end of lamp tube 20. Similarly, an electrode 56 at the opposite end of lamp tube 26 is electrically connected to an electrode 58 at the opposite end of lamp tube 58. These connections result in fluorescent lamp assemblies 10, 16 and 24 being electrically connected in parallel to output terminals 40 and 42 of RF source 30. The lamp tubes that comprise each fluorescent lamp assembly are effectively connected in series. Thus, lamp tubes 12 and 14 are connected in series.

The fluorescent light source of FIG. 1 further includes means (shown in FIG. 4) for initiating a low pressure discharge in each of the fluorescent lamp assemblies 10, 16 and 24. A suitable starting means is described below in connection with FIG. 4.

In a preferred embodiment, the fluorescent lamp assemblies 10, 16 and 24 are driven with RF voltages that are balanced with respect to ground. This can be accomplished by providing the RF source 30 with an output transformer 60 having a secondary winding 62 with a grounded center tap. In this case, the RF voltage on output terminal 40 is 180° out of phase with respect to the output voltage on terminal 42. The advantage of this configuration is that the ends of the fluorescent lamp assemblies 10, 16 and 24 opposite from the driven ends are at virtual ground and can be connected to ground. As shown in FIG. 1, electrodes 34, 38, 52, 54, 56 and 58 are connected to ground, thus eliminating any safety hazard at one end of each fluorescent lamp assembly. The fluorescent lamp assemblies 10, 16 and 24 can be driven with a RF source that is not balanced. However, in this case, the opposite ends of each fluorescent lamp assembly are not at virtual ground.

The configuration wherein the opposite ends of the lamp tubes are at virtual ground is convenient for electronic component placement. In addition, the virtual ground provides an ideal place to attach a screen to enclose the entire lamp structure to shield the RF energy from being emitted into the environment. The lamp tubes are spaced fairly closely together, typically within 0.75 inch between the axial center lines of two adjacent lamp tubes, so that minimal area is enclosed by each fluorescent lamp assembly, thereby minimizing RF radiation.

Figure 2:
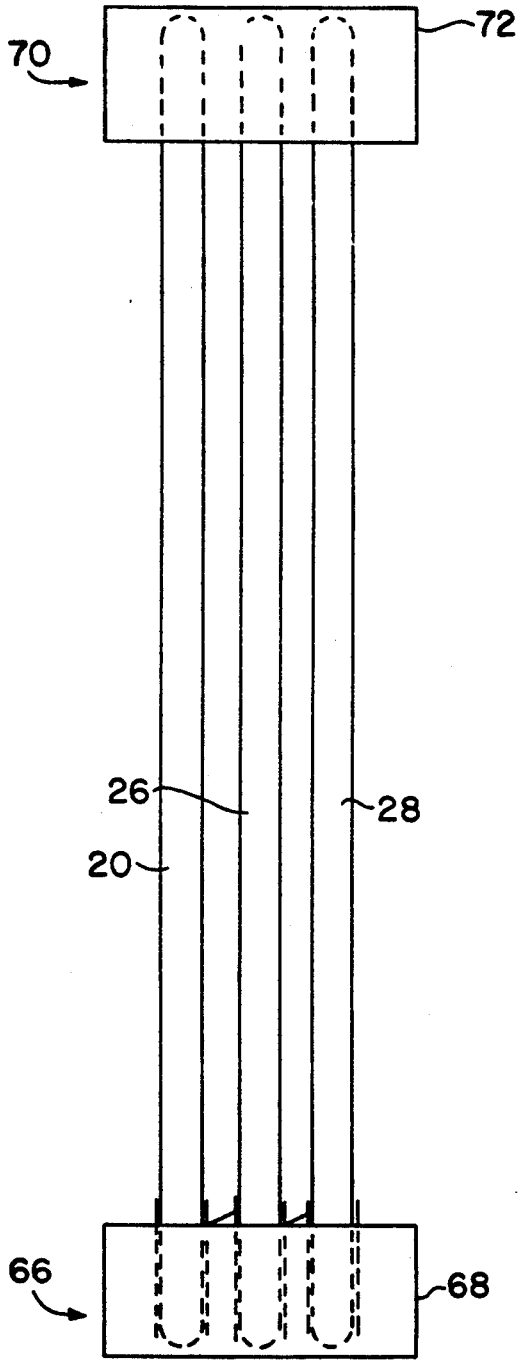
FIG. 2 is an elevation view of a suitable mounting arrangement for the fluorescent lamp tubes shown in FIG. 1.
Figure 3:
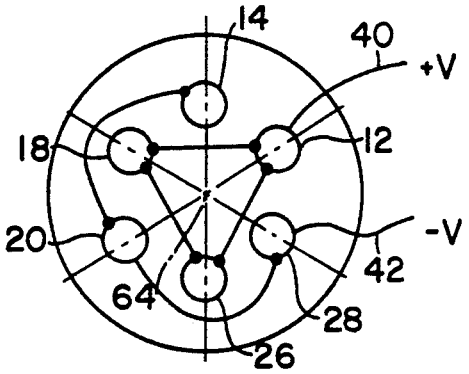
FIG. 3 is an end view of the fluorescent lamp tubes of FIG. 2, showing a preferred electrical phasing of the lamp tubes.

A suitable mounting arrangement for fluorescent lamp tubes 12, 14, 18, 20, 26 and 28 is shown in FIGS. 2 and 3. Lamp tubes 12, 14, 18, 20, 26 and 28 are mounted side-by side and parallel in a circular arrangement around a central axis 64. Opposite phases of the RF source 30 are applied to adjacent lamp tubes at driven end 66. An insulating block 68, such as Teflon® is used for support of the lamp tubes at driven end 66. At opposite end 70 of the light source, the lamps are electrically connected together and are supported by a virtual ground conductor 72, which can be aluminum.

Figure 4:
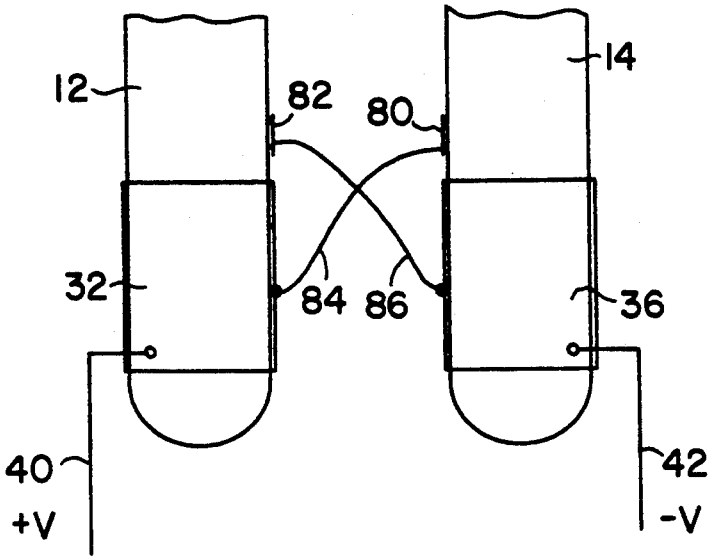
FIG. 4 is a partial schematic view of one of the pairs of fluorescent lamp tubes in the light source of FIG. 1, showing external capacitive coupling electrodes and starting electrodes.

An enlarged view of one end of lamp tubes 12 and 14 is shown in FIG. 4. Electrodes 32 and 36 can be metal layers, or bands, on the outside surfaces of lamp tubes 12 and 14, respectively. Preferably, electrodes 32 and 36 have a relatively large surface area to enhance capacitive coupling to the plasma of the low pressure discharges within lamp tubes 12 and 14. In this embodiment, no internal electrodes or filaments are required within lamp tubes 12 and 14. At a frequency of 27.12 MHz, external metal layers, or bands, having lengths of 0.75 inch are suitable for capacitive coupling of RF electrical energy to the discharge.

A circuit for starting a discharge within lamp tube 14 is shown in FIG. 4. A starting electrode 80 is positioned on lamp tube 14 near electrode 36. A starting electrode 82 is positioned on lamp tube 12 near electrode 32. Starting electrode 80 is connected by a thin wire 84 to electrode 32, and starting electrode 82 is connected by a thin wire 86 to electrode 36. The electrical connections to starting electrodes 80 and 82 ensure that the full RF voltage of source 30 is applied to localized regions of lamp tubes 12 and 14. This causes intense electric fields within the localized regions of lamp tubes 12 and 14 which are sufficient to initiate discharge. The electrodes 80 and 82 have small areas, thus ensuring that very little current passes through them after initiation of discharge. Thus, electrodes 80 and 82 do not affect normal operation of the fluorescent light source. Similar starting electrodes are utilized in each fluorescent lamp tube of the light source.

The balanced RF voltage $+V$ and $-V$ is applied to electrodes 32 and 36. The starting electrodes 80 and 82 typically apply 220 volts RMS to the lamp tube 14 to initiate discharge. In practice, this results in all lamp tubes breaking down simultaneously. The geometry of the starting electrodes 80 and 82 is not critical. Any configuration which intensifies the electric field sufficiently to achieve ignition at one point in the lamp tube is sufficient. Furthermore, other starting techniques known to those skilled in the art, including high voltage starting pulses, can be utilized.

For discharge initiation, it is important that the breakdown voltage applied across the diameter of the lamp tube be less than twice the operating voltage of any single lamp. With this form of ignition, it is not necessary that the lamp tubes have the same or nearly the same breakdown voltage. It is only required that the lamp tube breaks down at a voltage less than twice the voltage applied to the driven ends of the lamp tubes.

Thus, a considerable latitude in breakdown voltages is tolerable from lamp to lamp.

A fluorescent light source as shown in FIGS. 1–3 and described above was constructed. Each fluorescent lamp tube was a mercury argon lamp with a 5 mm inside diameter, a 7 mm outside diameter, and a length of 8 inches. The argon pressure in the lamp tubes was about 5 torr, but the argon pressure is not critical. The RF frequency was 27.12 MHz, but the RF frequency is also not critical. The driving frequency is selected to be high enough to capacitively couple sufficient current into the lamp without extremely high voltages (and power loss in coupling) and low enough that the lamps are only a small fraction of a wavelength. About 24 watts was delivered to the lamp tubes (about 4 watts per lamp tube), and the lumen output was about 1300 lumens. The lamp voltage applied to the metal band electrodes at the ends of the lamp tubes increases with discharge power but was about 220 volts RMS when the light source was operated at 24 watts.

Figure 5:
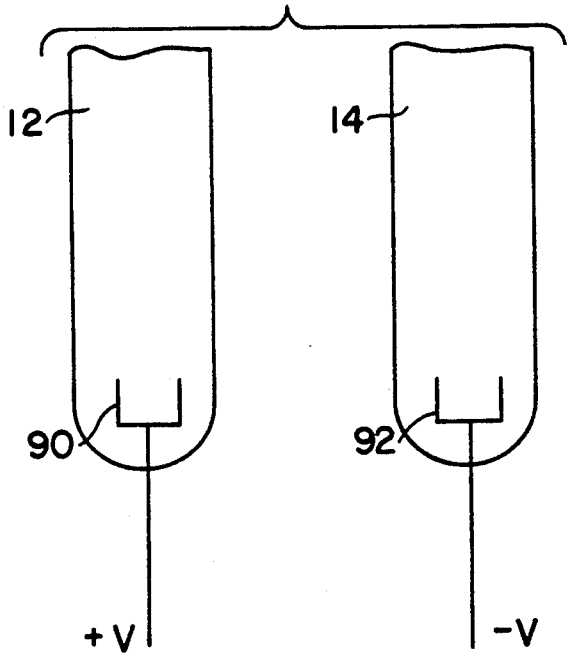
FIG. 5 is a partial schematic view of an alternate embodiment of the invention, showing a pair of fluorescent lamp tubes having cold cathode electrodes.

An alternative electrode configuration is shown in FIG. 5. A cold cathode electrode 90 is mounted within lamp tube 12, and a cold cathode electrode 92 is mounted within lamp tube 14. Similar cold cathode electrodes are mounted at or near the opposite ends of lamp tubes 12 and 14. The electrodes 90 and 92 typically comprise nickel and are selected to provide efficient capacitive coupling of RF electrical energy to the plasma within lamp tubes 12 and 14. The electrodes 90 and 92 have the advantage that capacitive coupling through the glass lamp envelope is not required. However, a sealed electrical feedthrough to each electrode is required. It will be understood that emission of electrons by electrodes 90 and 92 is not required.

The fluorescent light source shown in FIGS. 1–3 and described above utilizes three fluorescent lamp assemblies 10, 16 and 24. It will be understood that any number of fluorescent lamp assemblies can be utilized, provided that the RF source 30 can supply sufficient operating power to each of the lamp assemblies. In addition, a single fluorescent lamp assembly (such as assembly 10 in FIG. 1) can be operated by the RF source 30. In each configuration, RF electrical energy is capacitively coupled to a low pressure discharge within each fluorescent lamp tube. Ballasting of the fluorescent lamp tubes is provided by capacitive coupling between the plasma of the low pressure discharge and the electrodes, thus eliminating the need for external ballasting components. When internal electrodes are used, as illustrated in FIG. 5, ballasting is provided by the sheaths that form between the plasma and the electrode surfaces.

Figure 6:
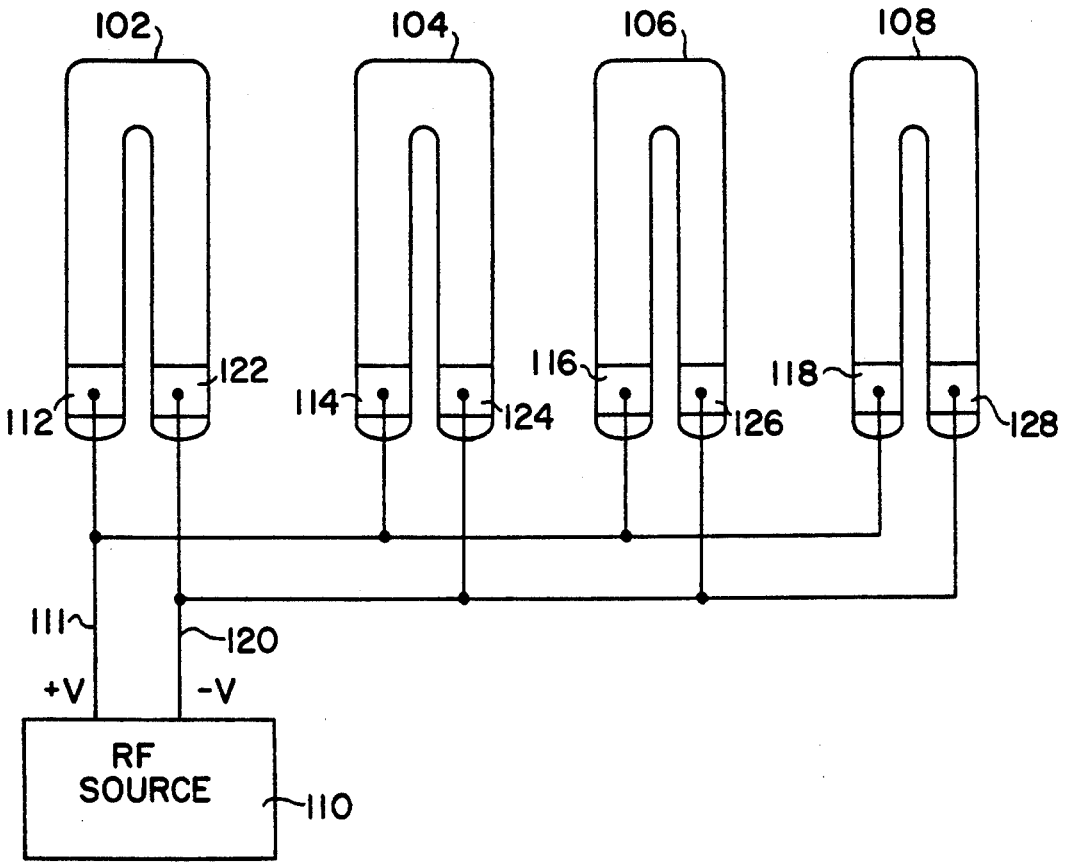
FIG. 6 is a schematic diagram of a fluorescent light source in accordance with the present invention wherein multiple twin tube fluorescent lamps are driven in parallel from a single RF source.

A fluorescent light source in accordance with another aspect of the invention, wherein a plurality of twin tube fluorescent lamps are driven in parallel by a single RF source, is illustrated in FIG. 6. Twin tube fluorescent lamps 102, 104, 106 and 108 are driven by a RF source 110. Each of the twin tube fluorescent lamps contains a fill material, such as argon and mercury, for sustaining a low pressure discharge and has a phosphor coating on its inside surface. Each of the twin tube fluorescent lamps includes a pair of straight tube sections that are interconnected at or near one end to form a generally U-shaped tube. Each twin tube fluorescent lamp includes capacitive coupling electrodes for capacitive coupling of RF electrical energy from source 110 to a low pressure discharge within the lamp. An output terminal 111 of RF source 110 is connected to electrode 112 of lamp 102, electrode 114 of lamp 104, electrode 116 of lamp 106 and electrode 118 of lamp 108. An output terminal 120 of RF source 110 is connected to electrode 122 of lamp 102, electrode 124 of lamp 104, electrode 126 of lamp 106 and electrode 128 of lamp 108. Output terminals 111 and 120 of RF source 110 carry opposite phases of the RF output voltage. Lamps 102, 104, 106 and 108 are connected in parallel to the output terminals 111 and 120 of source 110 without external ballasting.

The electrodes 112, 114, 116, 118, 122, 124, 126 and 128 can be metal layers, or bands, on the outside surfaces of the respective twin tube fluorescent lamps as shown in FIG. 4 and described above. Alternatively, the electrodes can be cold cathode electrodes mounted within the twin tube fluorescent lamps as shown in FIG. 5 and described above. In each configuration, RF electrical energy is capacitively coupled to a low pressure discharge within each twin tube fluorescent lamp. Ballasting of the florescent lamps is provided by capacitive coupling between the plasma of the low pressure discharge and the electrodes, thus eliminating the need for external ballasting components. When internal electrodes are used, as illustrated in FIG. 5, ballasting is provided by the sheaths that form between the plasma and the electrode surfaces.

Figure 7A:
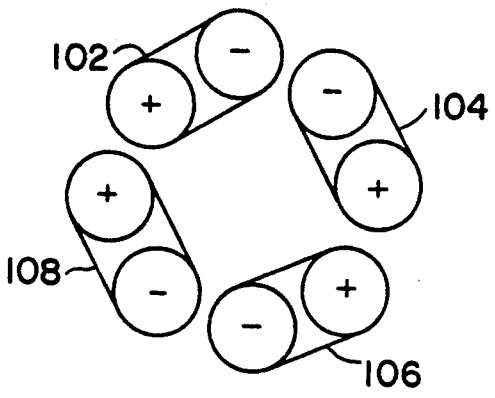
FIG. 7A–7C are end views of different mounting arrangements for twin tube fluorescent lamps driven by an RF source.
Figure 7B:
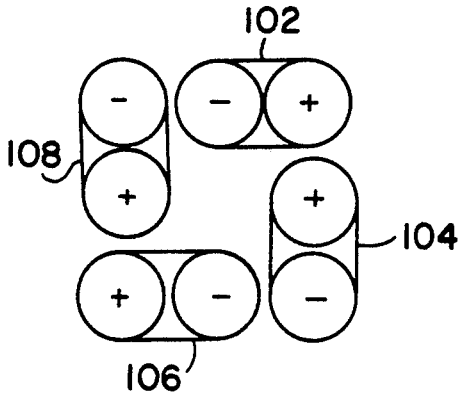
Figure 7C:
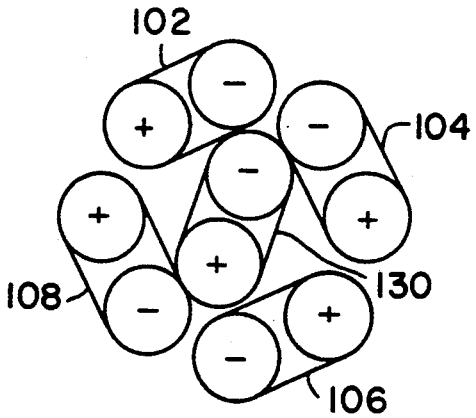

Three suitable patterns for configuring twin tube fluorescent lamps and the polarities of the voltages applied to each lamp are shown in FIGS. 7A–7C. The lamps are viewed from their ends in FIGS. 7A–7C. The position of each lamp is not critical, but the RF voltage applied to the arms of any one lamp must be of opposite phase. In FIG. 7C, a fifth fluorescent lamp 130 is utilized. It will be understood that the parallel configuration shown in FIG. 6 can utilize any number of twin tube fluorescent lamps, provided that the RF source 110 can supply sufficient operating power to each of the fluorescent lamps.

A typical operating frequency is 27.12 MHz. Frequencies in the range of about 3 MHz to 300 MHz are preferred. Most preferably, the operating frequency is in the range of about 10 MHz to 100 MHz.

The fluorescent light source shown in FIG. 6 is more efficient than the light source shown in FIG. 1 and described above because there is only one capacitive coupling surface for each straight tube section in the twin tube fluorescent lamp. In the light source of FIG. 1, each straight lamp tube has two capacitive coupling surfaces. Furthermore, in the light source of FIG. 6, the non-driven ends of each twin tube fluorescent lamp emit light, whereas in the configuration of FIG. 1, the non-driven ends are covered by electrodes. In addition, the connection between the two straight sections of the twin tube lamp contributes to the lamp length and emits light as efficiently as the straight sections.

A further advantage of the twin tube fluorescent lamp configuration of FIG. 6 is the simplification of starting. In a twin tube lamp, only one arm of each tube needs to be broken down to initiate a discharge, whereas in the light source of FIG. 1 comprising linear, parallel-driven lamps, every linear lamp must be broken down. A starting device or circuit is used in each of the twin tube fluorescent lamps. When ionization occurs in one arm of the lamp, the whole lamp ignites. Thus, a twin tube lamp requires half as many starting devices as compared with separate linear tubes. A starting electrode positioned on one arm of the twin tube lamp can be utilized as shown in FIG. 4 and described above.

Figure 8:
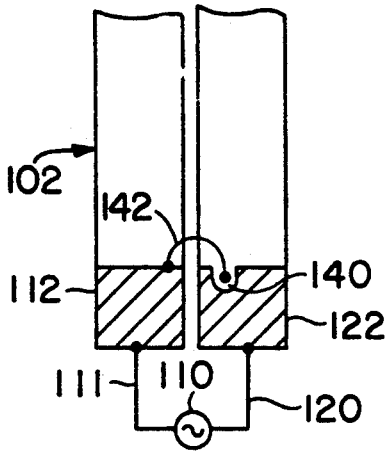
FIG. 8 is a partial schematic view of one of the twin tube fluorescent lamps in the light source of FIG. 6, showing a starting device.

A variation of the starting circuit is shown in FIG. 8. An enlarged view of one end of twin tube fluorescent lamp 102 is shown. A notch 140 is formed in electrode 122, and a thin wire 142 is attached to the lamp envelope in notch 140. The other end of wire 142 is connected to electrode 112. When the RF voltage of source 110 is applied to electrodes 112 and 122, a high field region is created within the lamp adjacent to notch 140, causing a discharge to be initiated. The wire 142, which has a small cross sectional area and carries very little current after initiation of discharge, does not affect normal operation of the fluorescent light source.

Figure 9:
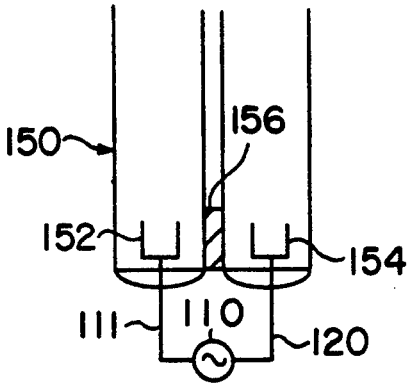
FIG. 9 is a partial schematic view of an alternate embodiment of the invention, showing a twin tube fluorescent lamp having cold cathode electrodes and a high permittivity dielectric material to enhance starting.

An alternative embodiment of the twin tube fluorescent lamp suitable for use in the fluorescent light source of the present invention is shown in FIG. 9. A twin tube fluorescent lamp 150 has internally mounted cold cathode electrodes 152 and 154 at opposite ends. To enhance starting, a high permittivity dielectric fill material 156 is located between the arms of the twin tube lamp 150. The high permittivity material increases the electric field inside the tube in the volume between the electrodes sufficiently to initiate breakdown. The high permittivity material can, for example, be glass having a dielectric constant of about 5.

Figure 10:
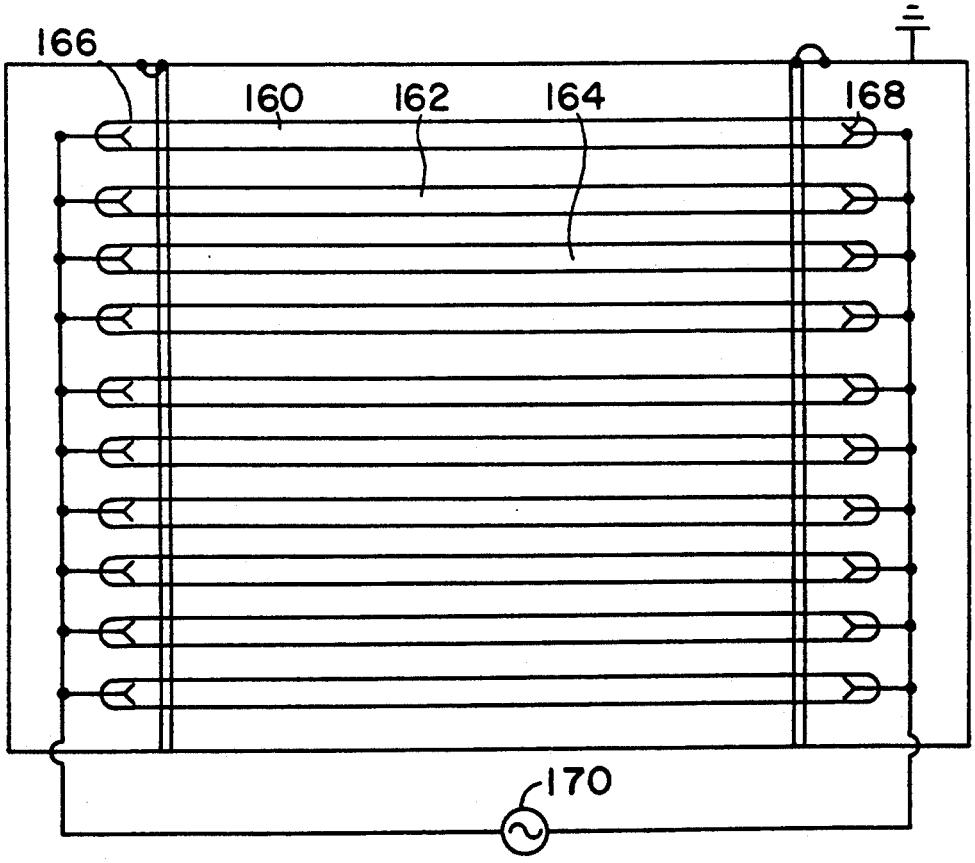
FIG. 10 is a schematic diagram of a fluorescent light source in accordance with another embodiment of the invention wherein multiple straight fluorescent lamp tubes are driven by a single RF source.

A fluorescent light source in accordance with the invention, wherein multiple straight florescent lamp tubes are driven in parallel from a single RF source, is shown in FIG. 10. Straight fluorescent lamp tubes 160, 162, 164, etc. have cold cathode electrodes mounted internally at opposite ends. The lamp tubes 160, 162, 164, etc. are electrically connected in parallel to a RF source 170. The electrodes 166, 168, etc. capacitively couple RF electrical energy to low pressure discharges within the fluorescent lamp tubes. Each fluorescent lamp tube contains a fill material, such as argon and mercury, for sustaining a low pressure discharge and has a phosphor coating on its inside surface. As noted previously, the sheath between each electrode and the plasma acts as a ballast. The frequency of operation is preferably in a range of about 3 MHz to 300 MHz and is most preferably in a range of about 10 MHz to 100 MHz.

In an example of the light source shown in FIG. 10, 10 miniature fluorescent lamps were operated in parallel. The lamp tubes were 8 inches long and about 7 mm outside diameter. The electrodes were nickel. The light source was operated at about 250 volts peak, 40 watts (4 watts per lamp) at a frequency of 27 MHz. The light output was about 2000 lumens and was generated from a panel of about $\frac{7}{8}$ inch thick.

The present invention permits multiple, linear or twin tube, small diameter fluorescent lamp tubes to be operated electrically in parallel using a single RF source. Long discharge tube lengths can be achieved without the complicated geometry required by a series configuration. The result is a geometrically simple fluorescent light source which can employ any number of parallel lamp tubes. A narrow discharge with a long discharge length can easily be achieved. Thus, a light source with a higher light output per unit volume can be attained. The light source is competitive with incandescent lamps with respect to light output per unit volume. The light source is more efficient and has a longer life than incandescent lamps.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A fluorescent light source comprising:

a plurality of fluorescent lamp assemblies, each comprising, first and second fluorescent lamp tubes having capacitive coupling electrodes at or near the ends thereof for capacitive coupling of RF electrical energy to a low pressure discharge in the respective lamp tube, each fluorescent lamp tube having a driven end and an opposite end, and means for electrically coupling the electrodes at the opposite ends of said first and second fluorescent lamp tubes together;

a single RF source having a first output terminal electrically coupled to the electrodes at the driven ends of each of said first fluorescent lamp tubes and having a second output terminal electrically coupled to the electrodes at the driven ends of each of said second fluorescent lamp tubes such that said fluorescent lamp assemblies are driven in parallel by said RF source, said RF source including means for applying RF voltages of equal amplitudes and opposite polarities to the electrodes at the driven ends of said first and second fluorescent lamp tubes; and starting means for initiating low pressure discharges within each of said fluorescent lamp tubes.

2. A fluorescent light source as defined in claim 1 wherein the output of said RF source has a grounded center tap and the electrodes at the opposite ends of each of said fluorescent lamp tubes are connected to ground.

3. A fluorescent light source as defined in claim 1 wherein said RF source has a frequency in the range of 3 MHz to 300 MHz.

4. A fluorescent light source as defined in claim 1 wherein said electrodes comprise conductive layers on the outside surface of each fluorescent lamp tube at or near the ends thereof.

5. A fluorescent light source as defined in claim 1 wherein said electrodes comprise cold cathode electrodes located within each fluorescent lamp tube at or near the ends thereof.

6. A fluorescent light source as defined in claim 1 wherein said starting means comprises means for applying the voltage of said RF source to a localized region of each of said fluorescent lamp tubes.

7. A fluorescent light source as defined in claim 1 wherein said starting means comprises a starting electrode positioned on each of said fluorescent lamp tubes near one of the capacitive coupling electrodes and electrically connected to said RF source.

8. A fluorescent light source as defined in claim 7 wherein said starting electrode has a sufficiently small area to avoid interference with the operation of said fluorescent lamp tube after starting.

9. A fluorescent light source as defined in claim 1 wherein said first and second fluorescent lamp tubes are substantially straight and are mounted parallel to each other.

10. A fluorescent light source comprising:

first and second fluorescent lamp tubes having capacitive coupling electrodes at or near the ends thereof for capacitive coupling of RF electrical energy to a low pressure discharge in the respective lamp tube, each fluorescent lamp tube having a driven end and an opposite end;

means for electrically coupling the electrodes at the opposite ends of said first and second fluorescent lamp tubes together;

a RF source having a first output terminal electrically coupled to the electrode at the driven end of said first fluorescent lamp tube and having a second output terminal electrically coupled to the electrode at the driven end of said second fluorescent lamp tube, said RF source including means for applying RF voltages of equal amplitudes and opposite polarities to the electrodes at the driven ends of said first and second fluorescent lamp tubes; and starting means for initiating low pressure discharges within said first and second fluorescent lamp tubes.

11. A fluorescent light source as defined in claim 10 wherein the output of said RF source has a grounded center tap and the electrodes at the opposite ends of each of said fluorescent lamp tubes are connected to ground.

12. A fluorescent light source as defined in claim 10 wherein said electrodes comprise conductive layers on the outside surface of each fluorescent lamp tube at or near the ends thereof.

13. A fluorescent light source as defined in claim 10 wherein said electrodes comprise cold cathode electrodes located within each fluorescent lamp tube at or near the ends thereof.

14. A fluorescent light source as defined in claim 10 wherein said starting means comprises means for applying the voltage of said RF source to a localized region of each of said fluorescent lamp tubes.

15. A fluorescent light source as defined in claim 10 wherein said starting means comprises a starting electrode positioned on each of said fluorescent lamp tubes near one of the capacitive coupling electrodes and electrically connected to said RF source.

16. A method for operating a fluorescent light source comprising the steps of:

providing a plurality of fluorescent lamp assemblies each comprising first and second fluorescent lamp tubes having capacitive coupling electrodes at or near the ends thereof, each fluorescent lamp tube having a driven end and an opposite end;

electrically coupling the electrodes at the opposite ends of the first and second fluorescent lamp tubes together;

coupling RF electrical energy to the electrodes at the driven ends of each of the first and second fluorescent lamp tubes such that said fluorescent lamp assemblies are driven in parallel;

applying RF voltages of equal amplitudes and opposite polarities to the electrodes at the driven ends of the first and second fluorescent lamp tubes such that the electrodes at the opposite ends of said fluorescent lamp tubes are at virtual ground; and initiating low pressure discharges within each of said fluorescent lamp tubes.

17. A fluorescent light source comprising:

a plurality of fluorescent lamp tubes, each containing a fill material for sustaining a low pressure discharge and having first and second electrodes at or near the ends thereof for capacitive coupling of RF electrical energy to a low pressure discharge within said lamp tube;

a single RF source having a first output terminal electrically coupled to the first electrode of each fluorescent lamp tube and a second output terminal electrically coupled to the second electrode of each fluorescent lamp tube so that said fluorescent lamp tubes are electrically connected in parallel, said RF source including means for applying RF voltages of equal amplitudes and opposite polarities to the electrodes at the driven ends of the fluorescent lamp tubes; and starting means for initiating a low pressure discharge within each of said fluorescent lamp tubes.

18. A fluorescent light source as defined in claim 17 wherein each of said fluorescent lamp tubes is substantially straight.

19. A fluorescent light source as defined in claim 17 wherein each of said fluorescent lamp tubes has a generally U-shaped configuration such that the first and second electrodes of each fluorescent lamp tube are located adjacent to each other.

20. A fluorescent light source as defined in claim 17 wherein said first and second electrodes comprise conductive layers on the outside surface of each of said fluorescent tubes at or near opposite ends thereof.

21. A fluorescent light source as defined in claim 17 wherein said first and second electrodes comprise cold cathode electrodes located within each of said fluorescent lamp tubes at or near opposite ends thereof.

22. A fluorescent light source as defined in claim 19 wherein said starting means comprises a high permittivity dielectric material located between the ends of each U shaped fluorescent lamp tube.

23. A fluorescent light source as defined in claim 17 wherein said starting means comprises means for applying the voltage of said RF source to a localized region of each of said lamp tubes.

24. A fluorescent light source as defined in claim 17 wherein said RF source has a frequency in the range of about 3 MHz to 300 MHz.

25. A fluorescent light source as defined in claim 17 wherein said RF source has a frequency in the range of about 10 MHz to 100 MHz.

26. A fluorescent light source as defined in claim 17 wherein said starting means comprises a starting electrode positioned on each of said fluorescent lamp tubes near one of the first and second electrodes and electrically connected to said RF source.

27. A fluorescent light source as defined in claim 17 wherein each of said fluorescent lamp tubes comprises a twin tube fluorescent lamp.

28. A method for operating a fluorescent light source comprising the steps of:

providing a plurality of fluorescent lamp tubes, each having first and second electrodes at or near the ends thereof for capacitive coupling of RF electrical energy to a low pressure discharge within the lamp tube;

coupling RF electrical energy to the electrodes of each of the fluorescent lamp tubes such that said fluorescent lamp tubes are driven in parallel;

applying RF voltages of equal amplitudes and opposite polarities to the electrodes at the driven ends of said first and second fluorescent lamp tubes; and initiating low pressure discharges within each of the fluorescent lamp tubes.

* * * * *